US005304080A

United States Patent [19]

Dilger

[11] Patent Number: 5,304,080

[45] Date of Patent: Apr. 19, 1994

[54] SWIM PADDLE

[76] Inventor: Christopher J. Dilger, 3191 S. Brockway St., Palatine, Ill. 60067

[21] Appl. No.: 143,076

[22] Filed: Oct. 25, 1993

[51] Int. Cl.[5] ..... A63B 31/10

[52] U.S. Cl. ..... 441/58; 441/56; 416/72

[58] Field of Search ..... 441/55, 56, 57, 58; 416/72, 73

[56] References Cited

U.S. PATENT DOCUMENTS

| | | | |
|---|---|---|---|
| 1,540,308 | 6/1925 | Samuels | 441/58 |
| 1,541,100 | 6/1925 | Barrett | 441/58 |
| 1,655,762 | 1/1928 | Englehart | 441/58 |
| 2,211,536 | 8/1940 | Clayton | 441/57 |
| 2,313,979 | 3/1943 | Tuma | 441/58 |
| 2,389,196 | 11/1945 | Harmon | 441/58 |
| 2,980,925 | 4/1961 | Wolshin | 441/57 |

*Primary Examiner*—Michael S. Huppert
*Assistant Examiner*—Thomas J. Brahan
*Attorney, Agent, or Firm*—Bullwinkel Partners, Ltd.

[57] ABSTRACT

A substantially flat, oval-shaped swim paddle for use on a swimmer's hand is provided having two halves connected by a flexible hinge. The anterior half has ridges defining finger indexes for placement of the swimmer's fingers. The posterior half has a centrally located raised palm portion which, when in use, fits comfortably within the hollow area of the swimmer's palm. Velcro ® type fasteners secure the paddle to the swimmer's hand. Texturing on the hand side of the paddle, the finger indexes and the raised palm portion allow the swimmer to more easily control the paddle.

7 Claims, 3 Drawing Sheets

SWIM PADDLE

BACKGROUND OF THE INVENTION

1. Field Of The Invention

This patent relates to swim paddles attached to a swimmer's hands and used to assist the swimmer by providing resistance which helps build upper body strength and, to a limited extent, by improving the stroke mechanics of the swimmer. More particularly, this patent relates to a swim paddle having, for better comfort and control, a flexible center hinge, finger indexes, and a raised palm portion.

2. Description Of The Related Art

Traditionally, swim paddles have been used by swimming coaches and other swimming technicians as a means of improving upper body strength and, to a limited extent, to improve the stroke mechanics of the swimmer. The present invention addresses the heretofore unmet need to have the swim paddle more closely conform to acceptable parameters of the swim stroke sequence, thus optimizing the training benefits afforded b paddles of this general type. That is to say, the invention enables a swimmer to better control the paddle, allowing the swimmer to use essentially the same swim stroke he or she uses without the paddle. Other less suitable paddles require the swimmer to slightly modify his or her swim stroke in order to maintain control of the paddle.

Conventional swim paddles are typically substantially square or rectangular in shape (see, eg., U.S. Pat. No. 3,529,313), thus acting as an unnatural extension of the surface area of the human hand. The unnatural surface area requires the swimmer to compensate for the uneven increase in surface area by adjusting his or her stroke.

A further disadvantage of many conventional swim paddles is their tendency to train the swimmer to spread his or her fingers in order to support the square or square-like paddle. The swimmer maintains spread fingers throughout the entire stroke sequence which stresses the hand and upper body in ways not intended by the swimmer, resulting in improper stroke mechanics. These adjustments run contrary to the training and stroke paradigms used by most swim coaches today.

With conventional paddles, the swimmer's hand and related muscle groups are often worked contrary to the swimmer's natural pull. As a result, swimmers may not obtain the type of conditioning consistent with his or her training goals. Worse, the added stress to the hand and associated muscle groups during the "pull-through" portion of the stroke sequence can be physically damaging.

The present invention provides a swim paddle which more closely conforms to the shape of a swimmer's hand and is more easily controlled by the swimmer than conventional swim paddles, allowing for a more natural swim stroke and better training results.

SUMMARY OF THE INVENTION

The present invention is a paddle for use on a swimmer's hand comprising a substantially flat anterior portion, a substantially flat posterior portion, a flexible hinge interposed between and connecting the anterior and posterior portions, a plurality of substantially parallel ridges extending substantially perpendicularly from the back side (hand side) of the anterior portion, a raised portion disposed on the back side of the posterior portion, and fastening means.

In the preferred embodiment, the back side of the paddle is textured to provide better grip and control. The opposite facing side is substantially smooth. The flexible hinge may comprise either (1) a plurality of transverse grooves, (2) a section of the paddle made of the same material as the two halves of the paddle but which is thinner than the two halves, or (3) a section made of a different material than the two halves, the hinge material being of such a density as to allow the paddle to flex along the flexible hinge.

The ridges define finger indexes and extend in a substantially longitudinal direction parallel to the axis of a swimmer's fingers when the paddle is mounted on the swimmer's hand. The ridges are spaced approximately evenly across the back side of the anterior portion of the paddle. The raised portion is substantially oval shaped and is located on the back side of the posterior portion such that the raised portion fits inside the hollow area of the swimmer's palm.

The fastening means preferably comprises first and second retaining straps formed of nylon webbing for releasably securing the paddle to the swimmer's hand. The first retaining strap is threadably connected to the anterior portion by means of slits disposed in the anterior portion. The second retaining strap is threadably connected to the posterior portion by means of slits disposed in the posterior portion.

Thus, it is an object of the present invention to provide a swim paddle which has improved gripping and flexing characteristics, and thus is more easily controlled by the swimmer, allowing for a more natural swim stroke and better training results.

A further object is to provide a swim paddle which more closely conforms to the shape of a swimmer's hand than conventional swim paddles.

Another object to provide a swim paddle which is quickly and easily strapped on and removed.

Further and additional objects will appear from the description, accompanying drawings, and appended claims.

DETAILED DESCRIPTION OF THE INVENTION

Figure 1:
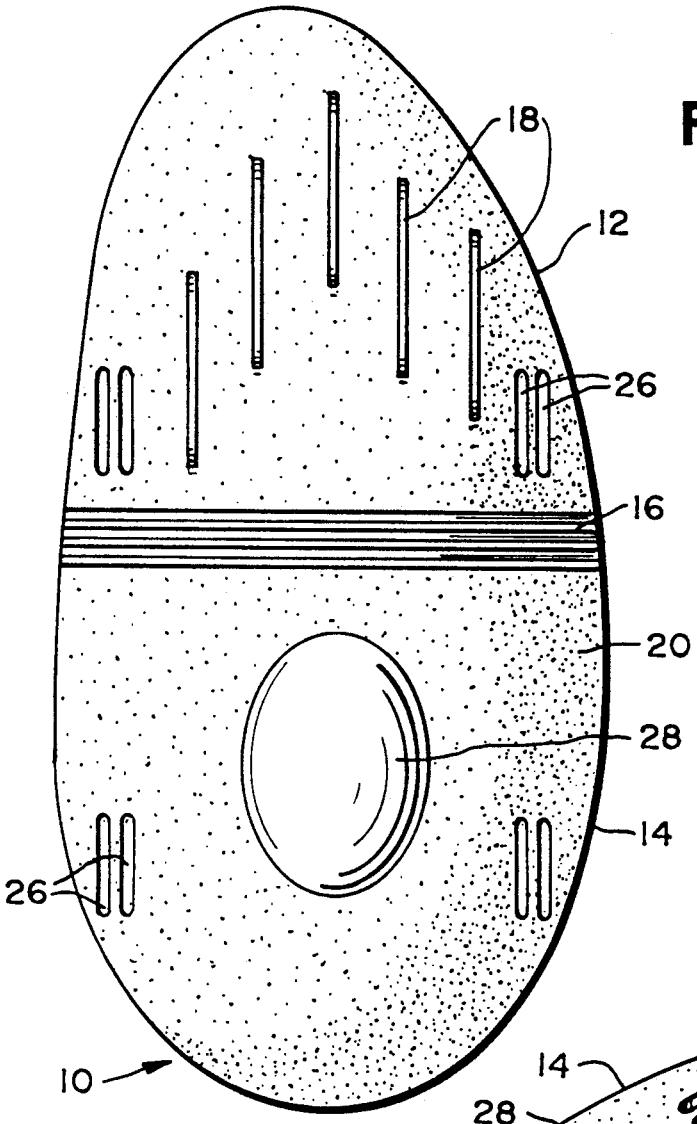
FIG. 1 is a top plan (back side) view of a swim paddle for the left hand according to the present invention, shown without retaining straps. The paddle for the right hand is a mirror image of FIG. 1.

Turning to the drawings, there is shown in FIG. 1 one embodiment of a swim paddle 10 according to the present invention. The swim paddle 10 comprises an anterior or front portion 12 and a posterior or back portion 14 connected by articulation means 16. The back side (the side in contact with the swimmer's hand) of both the anterior and posterior portions preferably is textured to provide better gripping. The opposite facing side (the side away from the swimmer's hand) preferably is smooth, but may also be textured, or even contoured.

Figure 2A:
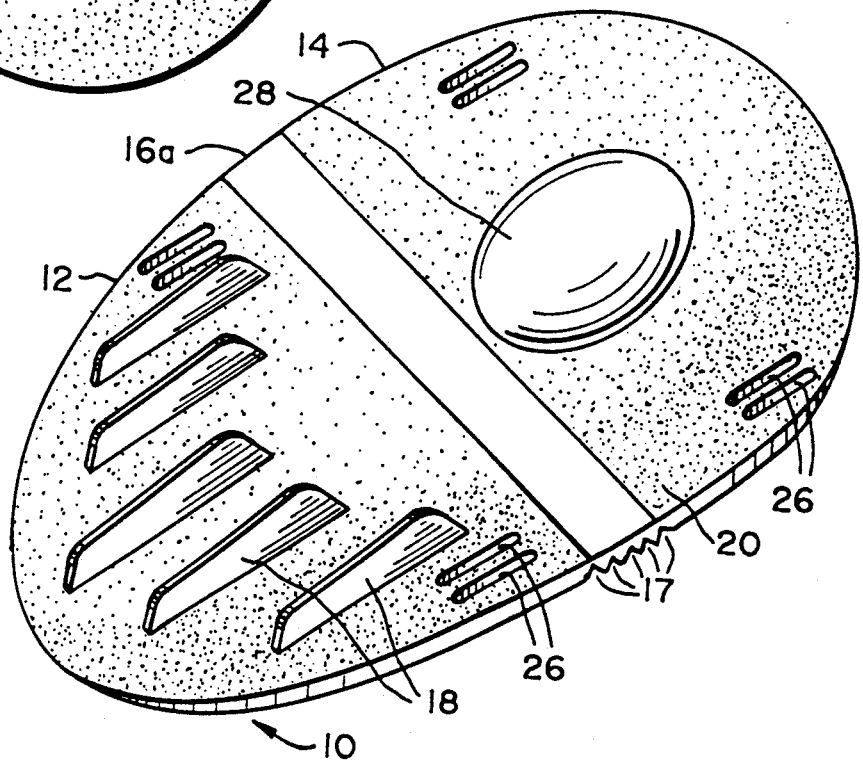
FIG. 2*a* is a perspective view of one embodiment of a swim paddle for the left hand according to the present invention, shown without retaining straps. The paddle for the right hand is a mirror image of FIG. 2*a*.
Figure 2B:
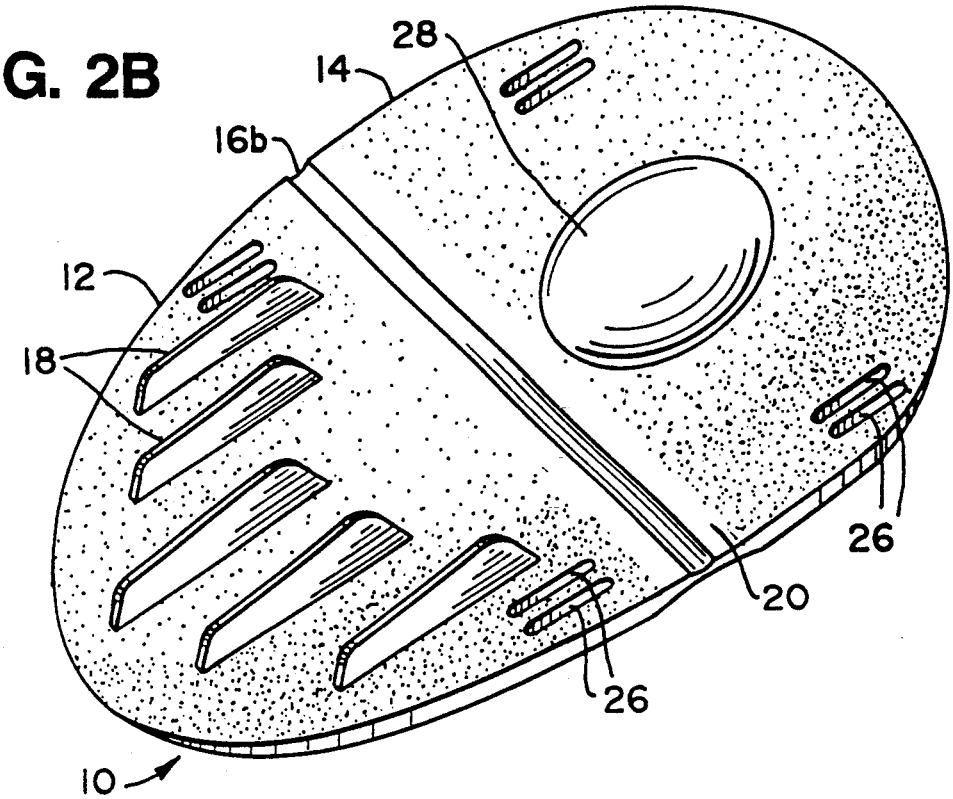
FIG. 2*b* is a perspective view of a second embodiment of a swim paddle for the left hand according to the present invention, shown without retaining straps. The paddle for the right hand is a mirror image of FIG. 2*b*.
Figure 2C:
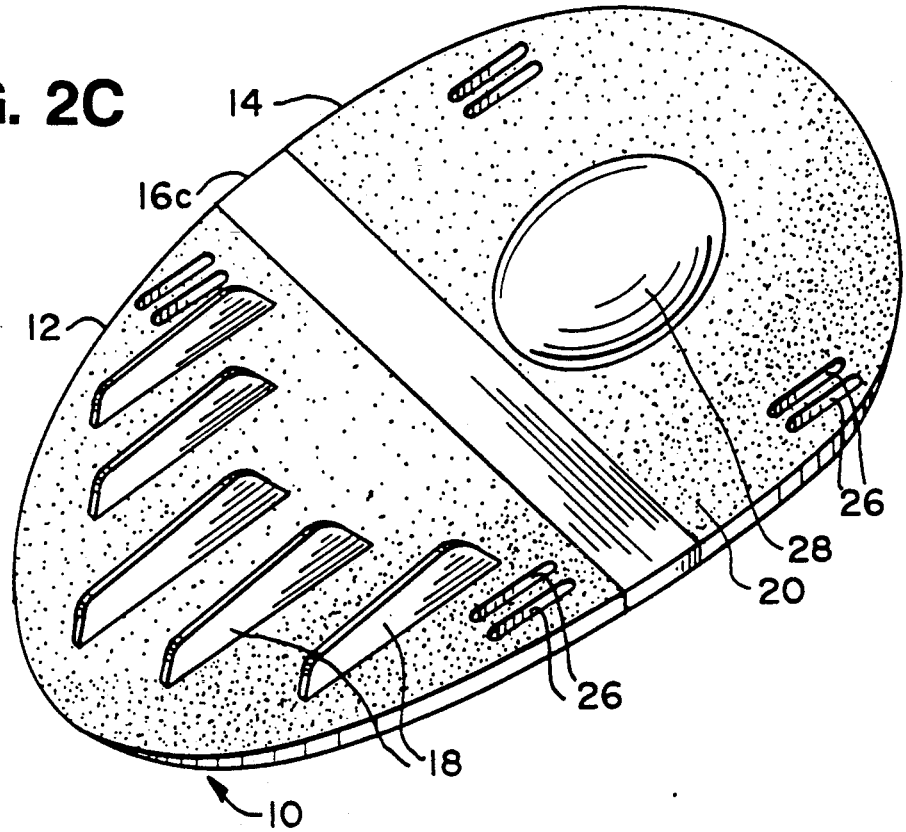
FIG. 2*c* is a perspective view of a third embodiment of a swim paddle for the left hand according to the present invention, shown without retaining straps. The paddle for the right hand is a mirror image of FIG. 2*c*.

In the preferred embodiment, articulation means 16 is a flexible hinge. The flexible hinge 16 is formed of flexible plastic or other suitable material. FIGS. 2a, 2b and 2c show three possible embodiments of the flexible hinge. In one embodiment (FIG. 2a), the flexible hinge 16a comprises a plurality of grooves 17 which allow the paddle 10 to flex. In another anticipated embodiment (FIG. 2b), the flexible hinge 16b comprises a section of the paddle 10 which is thinner than the anterior and posterior portions, thus allowing the paddle 10 to flex. In yet a third embodiment (FIG. 2c), the flexible hinge 16c comprises a section of the paddle formed of a different material than the anterior and posterior portions, the hinge material being if such a density as to allow the paddle 10 to flex. Other embodiments of the articulation means are contemplated which do not depart from the scope of the invention as claimed.

The flexible hinge 16 allows the swimmer to "cup" his or her hand for each reentry stroke into the water. This cupping action is more in conformity with the natural movement of the hands during a swimming stroke sequence.

Preferably, the surface area of the paddle 10 is slightly larger than the swimmer's hand, thus providing more resistance during the swimmer's pull through stroke than a hand only. Of course, if more resistance is desired, the paddle 10 can be made suitably larger.

In the preferred embodiment, the paddle 10 is somewhat oval shaped. The oval shape conforms more to the shape of a swimmer's hand than conventional square or square-like paddles, thus minimizing the need for the swimmer to adjust his or her stroke. However, other shapes are contemplated, including irregular shapes which even more closely resemble the shape of the swimmer's hand.

The preferred embodiment also comprises a plurality of substantially parallel raised or elevated ridges 18 spaced approximately evenly upon the backside 20 of the anterior portion 12 of the paddle 10. The ridges 18 extend in a substantially longitudinal direction parallel to the swimmer's fingers. The ridges 18 serve as indexes for the proper placement of the swimmers fingers through the stroke.

Figure 3A:
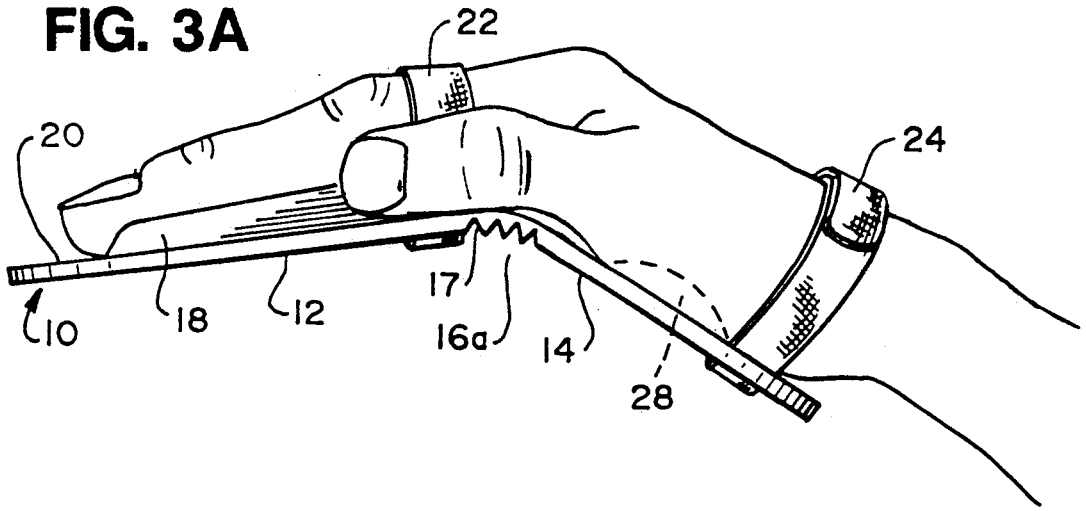
FIG. 3*a* is a side view of the swim paddle of FIG. 2*a* showing the paddle mounted on the right hand of a user.
Figure 3B:
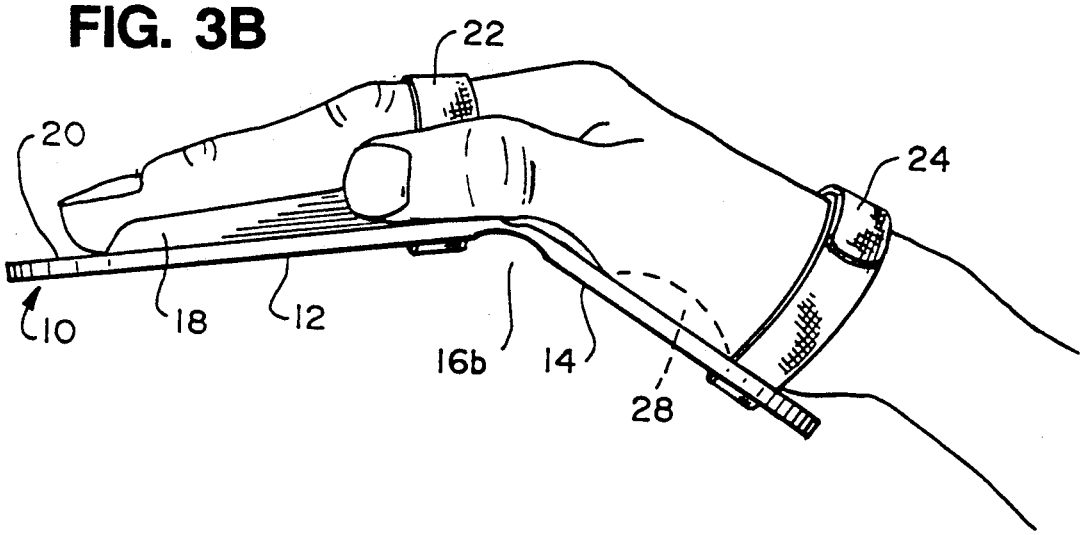
FIG. 3*b* is a side view of the swim paddle of FIG. 2*b* showing the paddle mounted on the right hand of a user.
Figure 3C:
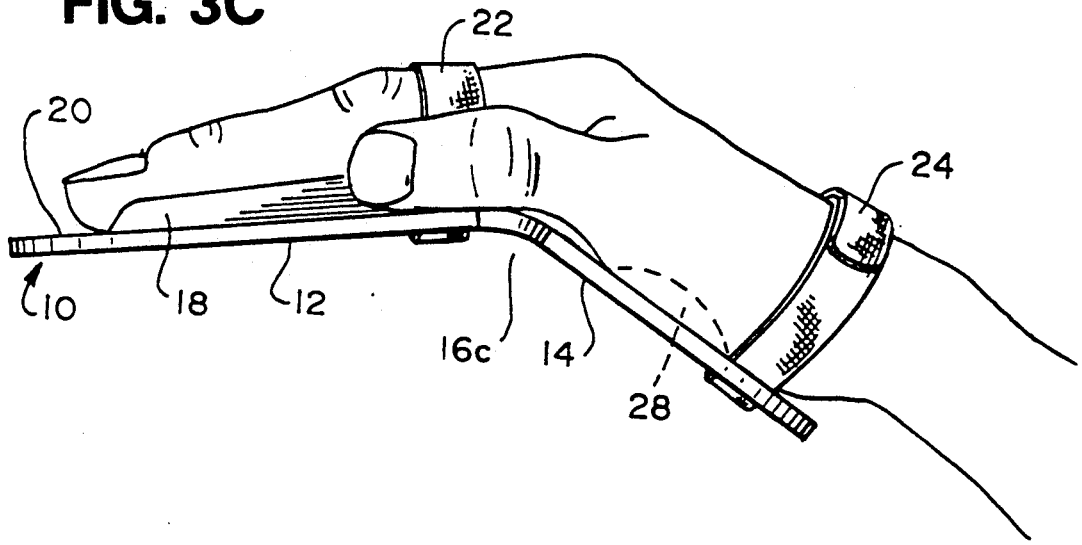
FIG. 3c is a side view of the swim paddle of FIG. 2c showing the paddle mounted on the right hand of a user.

In the embodiment shown in FIG. 1, five ridges 18 are shown. The swimmer's four fingers are placed between these ridges. The swimmer's thumb preferably is placed outside one ridge and is not restrained, as shown in FIG. 3. Alternatively, the swimmer's thumb may be placed between one ridge and the retaining strap 22, or between two ridges.

The retaining strap 22 and second retaining strap 24 preferably are formed of nylon webbing or other suitable material to secure the paddle to the swimmer's hand. In use, the straps are threaded through holes or slits 26 in the paddle 10 and secured by Velcro® or a Velcro®-like fastener, which provides comfort and facilitates attaching and removing the paddle.

The paddle 10 also comprises a raised portion or bulge 28 disposed in such a position on the back side 20 of the posterior portion 14 that the bulge 28 fits comfortably inside the hollow area of the swimmer's palm. The raised portion 28 (as well as the aforementioned texturing) reduces slipping while the paddle 10 is in use, allowing the swimmer to maintain better control of the paddle. The raised portion is preferably oval shaped, although other shapes are contemplated.

While the preferred form of the invention has been shown and described herein, it is to be understood that the invention is not to be taken as limited to the specific form described herein, and that changes and modifications may be made without departing from the true concept of the invention. It is therefore contemplated that the foregoing teachings and the appended claims define the present invention and any and all changes and modifications.

I claim as my invention:

1. A swim paddle for use on a swimmer's hand comprising:
   - a substantially flat anterior portion having a back side and an opposite facing side;
   - a substantially flat posterior portion having a back side and an opposite facing side;
   - articulation means interposed between and connecting the anterior and posterior portions;
   - a plurality of ridges extending substantially perpendicularly from the back side of the anterior portion and in a substantially longitudinal direction parallel to the axis of a swimmer's fingers when the paddle is mounted on the swimmer's hand, said ridges spaced approximately evenly across the back side; and
   - a raised portion disposed on the back side of the posterior portion such that the raised portion fits inside the hollow area of the swimmer's hand; and
   - fastening means connected to the anterior and posterior portions for releasably securing the paddle to the swimmer's hand.

2. The swim paddle of claim 1 wherein the back sides of the posterior and anterior portions are textured.

3. The swim paddle of claim 1 wherein the articulation means comprises a plurality of grooves disposed between the anterior and posterior portions of the paddle.

4. The swim paddle of claim 1 wherein the articulation means comprises a section of the paddle which is thinner than the anterior or posterior portions, and interposed therebetween.

5. The swim paddle of claim 1 wherein the articulation means comprises a section of the paddle interposed between the anterior and posterior portions and formed of a material of such density as to permit flexing.

6. The swim paddle of claim 1 wherein the fastening means comprises first and second retaining straps formed of nylon webbing, said first retaining strap threadably connected to the anterior portion by means of slits disposed in the anterior portion, said second retaining strap threadably connected to the posterior portion by means of slits disposed in the posterior portion.

7. A substantially oval-shaped swim paddle for use on a swimmer's hand comprising:

a substantially flat anterior portion having a textured back side and a substantially smooth opposite facing side;

a substantially flat posterior portion having a textured back side and a substantially smooth opposite facing side;

a flexible hinge formed of plastic and interposed between and connecting the anterior and posterior portions;

five substantially parallel ridges extending substantially perpendicularly from the back side of the anterior portion and in a substantially longitudinal direction parallel to the axis of a swimmer's fingers when the paddle is mounted on the swimmer's hand, said ridges spaced approximately evenly across the back side;

a substantially oval-shaped raised portion disposed on the back side of the posterior portion such that the raised portion fits inside the hollow area of the swimmer's hand; and first and second retaining straps for releasably securing the paddle to the swimmer's hand, said first retaining strap threadably connected to the anterior portion by means of slits disposed in the anterior portion, said second retaining strap threadably connected to the posterior portion by means of slits disposed in the posterior portion.

* * * * *

UNITED STATES PATENT AND TRADEMARK OFFICE

CERTIFICATE OF CORRECTION

PATENT NO. : 5,304,080

DATED : April 19, 1994

INVENTOR(S) : Christopher J. Dilger

It is certified that error appears in the above-identified patent and that said Letters Patent is hereby corrected as shown below:

Column 1, line 24, replace "b" with --by--.

Signed and Sealed this

Twenty-sixth Day of July, 1994

Bruce Lehman

*Attest:*

BRUCE LEHMAN

*Attesting Officer*

*Commissioner of Patents and Trademarks*